United States Patent [19]

Esper et al.

[11] Patent Number: 4,539,503

[45] Date of Patent: Sep. 3, 1985

[54] RAPID-HEATING, HIGH-TEMPERATURE-STABLE SPARK PLUG FOR INTERNAL COMBUSTION ENGINES

[75] Inventors: Friedrich Esper; Karl-Hermann Friese, both of Leonberg; Walter Gohl, Aidlingen; Peter Sternad, Gerlingen, all of Fed. Rep. of Germany

[73] Assignee: Robert Bosch GmbH, Stuttgart, Fed. Rep. of Germany

[21] Appl. No.: 435,643

[22] Filed: Oct. 21, 1982

[30] Foreign Application Priority Data

Nov. 7, 1981 [DE] Fed. Rep. of Germany ..... 3144253

[51] Int. Cl.[3] ..... H01T 13/14; H01T 13/20

[52] U.S. Cl. ..... 313/11.5; 313/143; 313/141

[58] Field of Search ..... 313/141, 143, 11.5

[56] References Cited

U.S. PATENT DOCUMENTS

| | | | |
|---|---|---|---|
| 3,061,756 | 10/1962 | Henderson | 313/145 |
| 3,113,232 | 12/1963 | Condelise | 313/130 X |
| 3,868,534 | 2/1975 | Eaton et al. | 313/141 |
| 4,314,392 | 2/1982 | Waite | 313/141 X |
| 4,400,643 | 8/1983 | Nishio | 313/141 X |
| 4,406,968 | 9/1983 | Friese et al. | 313/141 X |

FOREIGN PATENT DOCUMENTS

| | | |
|---|---|---|
| 2824408 | 12/1979 | Fed. Rep. of Germany . |
| 198345 | 3/1924 | United Kingdom . |
| 547119 | 8/1942 | United Kingdom . |
| 1110255 | 4/1968 | United Kingdom . |

*Primary Examiner*—Palmer Demeo
*Assistant Examiner*—Sandra L. O'Shea
*Attorney, Agent, or Firm*—Frishauf, Holtz, Goodman & Woodward

[57] ABSTRACT

In order to obviate the necessity for design compromise of spark plugs with respect to their operating temperature, so that the ceramic insulator (18) of the spark plug will rapidly reach the temperature at which deposits thereon will inherently burn off (about 400° C.–450° C.) while not becoming so hot as to cause spurious glow ignition within the combustion chamber of an internal combustion (IC) engine, the end portion of the insulator is formed with a central opening (19/3) within which a metal core (24) is included which has a temperature coefficient of expansion such that, at temperatures below between 400° C.–450° C. it is spaced by a narrow gap (25) from the inner surface of the insulator (see FIG. 1) but, as the spark plug becomes hot, the gap 25 closes (FIG. 2), thereby providing good heat transmission from the insulator to the center electrode structure (21, 23, 24) and thereby maintaining the insulator at a temperature below that at which it might glow. Suitable materials for the center electrode are aluminum bronze, or other materials having a heat transmission characteristic of at least 90 W/mK. The insulator, preferably, has a higher-than-usual flux content so that, at low temperatures, its heat transmission characteristics are poor, to insure rapid heating to free combustion temperature of possible deposits.

20 Claims, 5 Drawing Figures

RAPID-HEATING, HIGH-TEMPERATURE-STABLE SPARK PLUG FOR INTERNAL COMBUSTION ENGINES

Reference to related patents and publications:

U.S. Pat. Nos. 2,603,200; 3,113,232

U.S. Pat. Nos. 3,909,459; 3,061,756.

German Patent Disclosure Document DE-OS No. 31 32 903 corresponding U.S. Ser. No. 398,360, July 15, 1982

German Patent Disclosure Document DE-OS No. 28 54 071, U.S. Pat. No. 4,261,085

German Patent Disclosure Document DE-OS No. 27 29 099, U.S. Pat. No. 4,144,474

German Patent Disclosure Document DE-OS No. 28 24 408

German Patent Disclosure Document DE-OS No. 30 38 720 corresponding U.S. Ser. No. 397,353, August 28, 1981

Swiss Patent No. 105,078 corresponding to GB No. 198 345

British Patent No. 547,119. German Patent No. 1,207,709 corresponding to British No. 1,110,255.

The present invention relates to spark plugs for internal combustion engines, and more particularly to spark plugs for automotive-type internal combustion engines.

BACKGROUND

Spark plugs usually have a tubular metal housing which is externally threaded to be fitted into the cylinder head of an internal combustion (IC) engine. A rotation-symmetrical insulating body, which is highly heat-resistant, is located within the metal housing. The metal housing, normally, has a central opening or bore in which the insulator is fitted. The insulator, typically, is a ceramic, which may have a porcelain glaze on the outside. The spark plug has a terminal end, outside of the combustion chamber, adapted to receive an electrical terminal connected to an ignition cable; and a combustion end, in which a center electrode, passed through the insulator, projects from the insulator by a small distance, to form a spark gap with one or more ground or chassis electrodes which protrude from the combustion chamber side of the metal housing.

It has already been proposed to form the center electrode of several elements, for example a terminal end which is positioned opposite the ground or chassis electrode to form therewith a spark gap, electrically in series with a metal core within the insulator, which projects outside to be connected to the ignition cable. It has also been proposed - see U.S. Pat. No. 2,603,200 - to retain an electrically conductive liquid within the central bore of the insulator, for example mercury, or a metal which has a low melting point, such as bismuth, tin, lead, or antimony. At normal operating temperatures, the liquid or readily liquefying metal, is in the liquid phase. Such spark plugs require a considerable time before the insulator at the ignition end reaches a temperature of between 400° C. and 450° C. This is the temperature at which deposits which collect on the insulator will burn off, and thus prevent leakage or creep or short-circuiting paths along the insulator between the center electrode and the metal housing. The heat transfer from the insulator to the liquid or readily liquefying metal within the center bore of the insulator is excellent during the initial heating of the spark plug, so that the heat transfer from the insulator to the metal body is good, and thereby extending the heating of the spark plug to the temperature at which deposits will burn off. Spark plugs of this kind, that is, which remain below the self-burning temperature of between 400° C. and 450° C., for a relatively long time are subject to deposits of electrically conductive materials, such as carbon black or soot, on the insulator body. The relatively long time before such deposits will burn off may lead to misfires of the spark plug, and electrical shunt paths. Such spark plugs usually have a thin central opening between the region where the liquid metal and the center electrode are placed. In operation, short circuits may arise since the liquid metal will grow or penetrate through the bore, and may form a bridge in the direction towards the ground or chassis electrode, thus short-circuiting the spark plug.

It has also been proposed to provide spark plugs which, in combination with their center electrode within the insulator, have a metal core made of copper or silver, and introduced into the insulator in the form of a powder or a rod. This core is heated and press-fitted within the insulator in order to obtain tight and close contact between the metal core and the insulator. Such spark plugs, also, require a considerable period of time before they reach the self-combustion temperature of deposits. Spark plugs of this kind are described, for example, in British Patent No. 547,119. It has also been proposed to construct spark plugs by introducing silver into the central bore of the insulator body by centrifugal casting, so that no gap will occur between the center core and the insulator (see U.S. Pat. No. 3,113,232). It has also been proposed to press-fit a metal core made of copper or nickel within the insulator, and to add materials to the metal core which modify its temperature coefficient of expansion so that it will match at least approximately that of the insulating body (see U.S. Pat. No. 3,061,756). Such spark plugs, also, due to the tight fit between the insulator and the spark plug, have good heat transmission characteristics so that, upon starting, or upon idle operation of the engine, the self-burning temperature is reached only late, if at all.

At high loading of the engine, and during extended operation under load, the spark plug may get very hot and, if the heat of the spark plug becomes excessive, the tip end of the insulator, or the metal core, may begin to glow, which may lead to misfires of the engine. Thus, the ideal spark plug should heat rapidly to a temperature which is above the self-igniting temperature of deposits, but will not heat to such an extent that glow ignition due to excessive heating of the insulator or surrounding elements will result. It is difficult to find materials which have the requisite characteristics of at least approximately matched temperature coefficients of expansion, which are insulating for the insulator, conductive for the center core, rapidly reach a temperature which is above the inherent combustion temperature of deposits, but will still have sufficient heat transfer characteristics to the metal housing so that the spark plug, even under extended heavy loading, will not reach the temperature at which glow ignition may result.

THE INVENTION

It is an object to provide a spark plug which has the characteristics of rapidly reaching and exceeding the self-ignition temperature of deposits, while having good heat transmission and heat conduction characteristics at high temperatures, so that it will not cause glow ignition and reach excessive temperatures.

Briefly, the metal core of the spark plug is made of a material which has a coefficient of expansion such that, at temperatures below the self-ignition temperatures of about 400° C. to 450° C., it will form a gap with respect to the surrounding insulator, or will shrink, so that heat transfer from the center electrode or core to the insulator is poor, thus resulting in rapid heating. At temperatures between about 450° C. and 500° C., however, the material expands and closes the gap. It will fit against the insulator, thereby cooling the insulator after it has reached the self-combustion temperature for deposits, and preventing the insulator from reaching excessive temperatures which, otherwise, might lead to glow ignition.

The material for the center electrode preferably has a heat conductivity of at least 90 W/mK,(+) and uses, for example, aluminum, copper, silver, or metal alloys which have a considerable proportion of at least one of those materials, such as brass, aluminum bronze, tin bronze, or the like. The insulator preferably is made of aluminum oxide desirably with a relatively high content of flux material, for example between about 5% to 20%, preferably between about 8% to 15% (by weight). Customary insulators have only about 5%, or less, flux content. The heat conductivity of the insulator at temperatures below 600° C. is less than customary insulators, whereas the heat conductivity above 600° C. to 700° C. is about the same as customary materials. Due to the higher flux content, the insulator will soften at a lower temperature than insulators with a lower flux content. Yet, this does not interfere with operation of the spark plug since the operating temperatures are far below the softening temperature of the ceramic. In a preferred range, the flux content is higher than in customary insulators.

(+) Watt/Meter × Kelvin

The spark plug has the advantage that it will rapidly reach the self-combustion temperature of deposits of between 400° C. to 450° C., so that electrically conductive deposits at the combustion side of the insulator will burn off quickly. Deposits which might cause shunt circuits or creep paths will burn off quickly. Yet, the spark plug will not heat excessively and will prevent the occurrence of glow ignition at high operating temperatures since, at the high temperatures, good heat conductivity from the combustion side of the insulator is obtained due to the then obtaining tight connection between insulator and center electrode.

Spark plugs of this type have the further advantage that they can be used with a larger number of types of IC engine than known spark plugs since the heat transfer or heat transmission characteristics of the spark plug at the combustion side thereof will automatically match the thermal loading to which the spark plug is exposed.

The spark plug does not use any liquid or materials which liquefy at operating temperature, so that the danger of possible escape of liquid material from the center bore in the insulator, which might lead to short circuits, is eliminated.

In accordance with a preferred feature of the invention, and to rapidly reach self-ignition or combustion temperature of deposits, the insulator is a thin-walled element at the combustion side, and/or the insulator material which is used is one which, at low temperature, has poor heat conductivity. It is possible and desirable in some applications and for some engines to fit a separate center electrode in the bottom of the insulator, which is made of a material which, at low temperature, is poorly heat-conductive.

The spark plug can be easily made, has a long lifetime, and is little affected by erosion and corrosion, which might change the gap of the plug. The manufacture and assembly thereof is simple, so that the overall costs, due to material and energy consumption in manufacture of the plug, as well as apparatus requirements and labor costs, are low.

DRAWINGS

DETAILED DESCRIPTION

Figure 2:
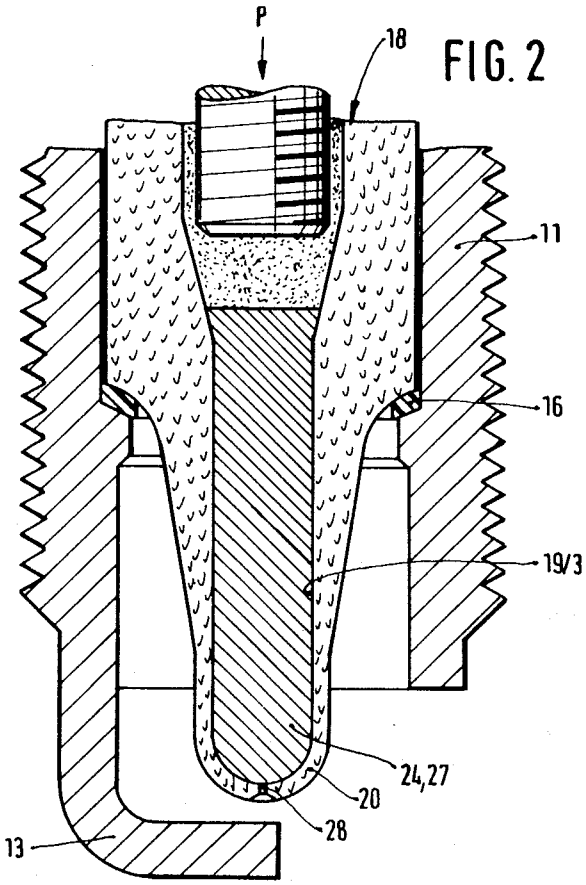
FIG. 2 is a view similar to FIG. 1 with the spark plug at operating temperature.

The spark plug 10 is, at the outside, of any suitable and standard construction, and has a tubular metal housing 11 which has an outer thread 12. The metal housing is extended upwardly—with respect to FIG. 1—and forms a hexagonal surface for attachment to a spark plug socket wrench. The metal housing 11 is extended at the ignition or combustion chamber end to a bent-over portion 13 which forms a ground or chassis electrode. The end 13 is bent over towards the center line or longitudinal axis of the spark plug.

The metal housing 11 is formed with a tubular opening 14 which has an internal shoulder 15. An insulator 18, of rotation-symmetrical form, is seated on the shoulder 15, with interposition of a sealing ring 16, which engages an enlarged portion 17 of the insulator body 18. The ground or chassis electrode 13 may be formed in accordance with any suitable and standard construction, and more than one center electrode or a ring of electrodes 13 may be provided. The insulator 18 is fitted in the opening 14 in accordance with any suitable and well known construction, for example by rolling-over a portion of the metal housing 11 at the connection of terminal end (not shown), by shrink-fitting, or the like. The insulator may be fitted into the metal housing also by a cement, or otherwise. The combustion chamber end of the insulator body extends towards the chassis electrode 13; the cross-sectional area of the insulator decreases, that is, the insulator tapers downwardly towards the chassis electrode 13. The head of the insulator 18 at the terminal end portion—not shown in FIG. 1—extends from the metal housing 11 and surrounds a connection bolt or post 21, which is formed with an ignition cable terminal.

The insulator 18 has a longitudinal opening or bore 19, extending axially, which has an enlarged portion 19/1 extending towards the terminal end of the spark plug. The enlarged portion 19/1 tapers in a tapering central portion 19/2 to a narrower or thinner end portion 19/3 adjacent the combustion chamber end of the spark plug. The insulator 18 has a cup-shaped or dome-shaped bottom 20, integral therewith. The thickness of the bottom dome 20 is only about 0.4 mm. The portion of the insulator 18 adjacent the dome-shaped bottom also is only about 0.4 mm thick-measured in cross section, for an axial length of about 6 mm. The dimensions are not critical and, depending on application, the end portion of the insulator 18 in the region of the bottom 20 and extending upwardly therefrom, may have a thickness of between, for example, about 0.2 mm to 0.9 mm, preferably in the range of from 0.3 mm to 0.6 mm. The axial extent of the region of this thickness of the insulator 18, depending on application, may be between about 2.5 mm to 12 mm, preferably, however, between 5 mm to 9 mm. The transition from this thin-walled region of the insulator 18 towards the enlarged portion 17 should be matched to the length and the wall thickness, and increase gradually—as well known in connection with spark plug construction.

The insulator 18 preferably essentially is made of aluminum oxide. The aluminum oxide of the insulator body has, preferably, but not necessarily, a higher percentage of flux added thereto than used with customary and standard spark plugs. A suitable addition is about 10%—by weight—of flux, the flux being, for example, magnesium silicate or calcium silicate. The relatively high proportion of flux—with respect to customary insulating bodies, which contain only about 5%, by weight, of flux—has the effect that the heat conductivity of the insulator 18 at temperatures below 600° C. is less than in known insulators; the heat conductivity of the insulator 18, at temperatures above about from 600° C. to 700° C. is, essentially, comparable to that of customary material of lesser flux content. The lower softening point of the insulator, due to the higher content of flux, does not interfere with the operation of the spark plug 10, since the operating temperatures of the spark plug 10 are far below the softening temperature of such ceramics. The proportion of flux in the insulator 18 may vary between about 3% to 20% by weight; the insulator for use in the spark plug of the present invention, preferably, has a flux content of between 8% and 15%, by weight.

A metallic connecting bolt 21 extends through the insulator 18 in the longitudinal opening 19 thereof, up to and including the connecting region 19/1 of the central opening. The connecting bolt 21, at the terminal end of the spark plug (not shown) is formed in accordance with standard construction, for example by having a thread or a connecting tip formed thereon. At the combustion chamber end, it is preferably formed with attachment deformations 22, for example, a thread, grooves, and ridges, a stippled or knurled surface, or the like. These attachment arrangements 22 insure that the connecting bolt 21 is reliably and tightly secured in the spark plug. An electrically conductive sealing mass 23 embeds the connecting terminal 21, together with the attachment arrangement 22. The sealing mass 23 is fitted in the region 19/1 and 19/2 of the opening 19 in the insulator 18 of the spark plug. Sealing masses of this type are well known and, preferably, include an electrically conductive glass melt (see, for example, U.S. Pat. No. 3,909,459). The sealing mass 23 is in electrically conductive connection and position with respect to a metal core 24 which is located in the combustion chamber end portion 19/3 of the central opening of the insulator 18. It may extend, at least in part, into the central portion 19/2 of the longitudinal opening in the insulator.

In accordance with the present invention, the core 24, when the spark plug is cold, or below normal operating temperature, is fitted into the insulator 18 but, at least in the combustion end portion 19/3, and, possibly, at least within a portion 19/2 of the opening 19 of the insulator, the core 24 and the insulator are spaced by a narrow gap 25. This narrow gap is present only when the temperature of the end portion of the insulator 18 which extends into the combustion chamber is below the free-burning or self-ignition temperature of about 450° C. of deposits which might precipitate on the insulator. After the temperature of the spark plug, at the combustion chamber end, reaches about 450° C. to 500° C., the gap will close—see FIG. 2.

The characteristics of the metal core to close the gap are due to expansion thereof upon rise in temperature. The coefficient of expansion of the metal core 24 is greater than that of the ceramic material of the insulator 18.

In accordance with a feature of the invention, the metal core 24 is preferably made of aluminum bronze, including about 8% aluminum. Other materials with similar coefficients of expansion, and good heat conductivity, may be used. Suitable materials for a metal core 24, besides aluminum alloys, are copper alloys, silver, or metal alloys which contain at least a substantial proportion of one of the materials: copper, silver or aluminum—for example brass or tin bronze. Suitable metals or metal alloys which are used for the core 24 should have a heat conductivity of more than 90 W/mK. These metal alloys, at melt-in temperatures, are either liquid, or plastically deformable, so that, upon introduction of the metal core 24 and sealing mass 23 within the insulator 18, they fill the region 19/3 and, possibly, an adjacent region 19/2 of the opening 19 within the insulator without a gap.

The core 24, preferably, is conically expanded at the upper end by fitting within the conical portion 19/2 of the opening to insure a reliable seat within the insulator 18, and prevent any possible longitudinal movement therein.

Manufacture and assembly of the spark plug: In a preferred form, the metal core 24 is made of aluminum bronze. The insulator 18, connecting bolt 21, sealing mass 23 and metal core 24 are assembled in this manner: An aluminum bronze rod of predetermined volume is fitted within the longitudinal bore 19 of the insulator 18, locating it within the combustion chamber region 19/3 of the insulator opening, to completely fill the end portion of the opening 19. A previously measured quantity of granulated sealing mass 23—which may be introduced also in form of a tablet, rather than as separate granules—is introduced above the aluminum bronze rod within the opening 19. In a subsequent assembly operation, the connecting bolt or post 21, with the anchoring arrangement 22, is fitted within the insulator bore 19.

The subassembly, which is longitudinally positioned, is then heated to the melt-in temperature of the sealing mass 23. A suitable temperature is, for example about 900° C. Pressure is applied to the connecting post 21 in downward direction—see FIG. 1, as schematically indicated by arrow P (FIG. 2)—of such magnitude that the heat-deformable aluminum bronze rod will deform or slightly flow so that it will fit with its entire surface within the corresponding region of the longitudinal opening 19 in the insulator—see FIG. 2. The assembly is then cooled, while retaining pressure on the connecting bolt 21, until shortly before the transformation point of the sealing mass 23 is reached, for example at about 500° C. Upon subsequent cooling of the assembly, the metal core 24 will separate from the insulator 18 to form the gap 25—see FIG. 1.

To control the desired heat transmission from the combustion side end portion of the insulator 18 towards the connecting portion of the spark plug 10, the volume of the metal core 24 may be suitably controlled and selected. The metal core can reach more or less into the region of the sealing ring 16; it may be formed with stepped or different diameters.

Rather than using the sealing mass 23 which employs a conductive glass flux, other sealing masses can be used which, for example, additionally can include resistance elements, so that the sealing mass 23 may, at the same time, form a radio noise suppression resistor.

Figure 1:
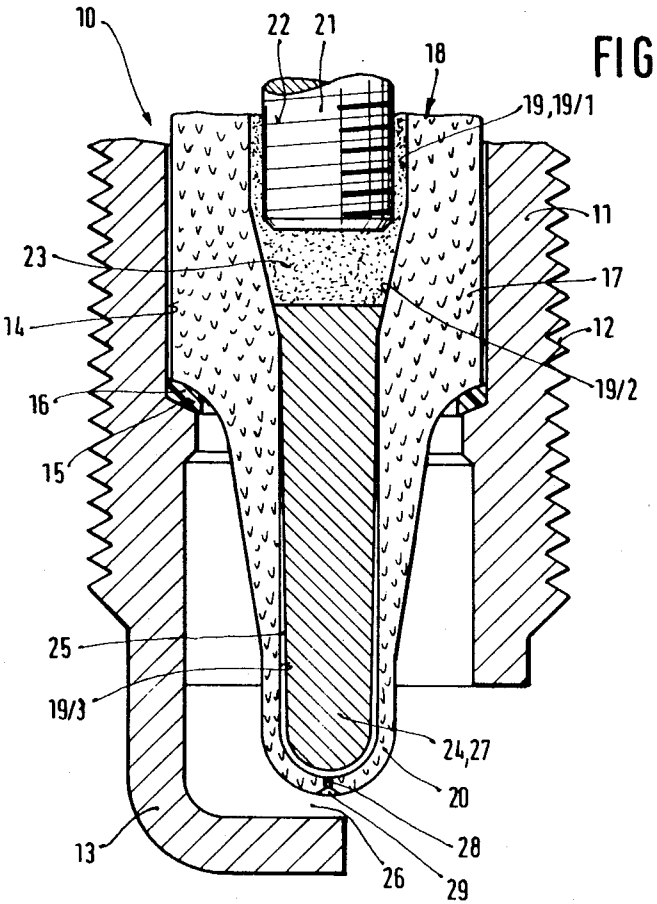
FIG. 1 is an enlarged lontitudinal cross-sectional view through the ignition end portion of a spark plug, when the plug is in cold condition.

The dome 20 is spaced from the ground or chassis electrode 13 by a gap 26. Such a gap, for example, is about 0.8 mm. In the preferred embodiment of the invention—as shown in FIGS. 1 and 2—the metal core 24 simultaneously forms the center electrode 27 of the spark plug, and sparking occurs between the center electrode 27 and the ground electrode 13 over a path 28 formed as a narrow opening within the dome-shaped body 20 of the insulator, and the air gap 26 between the insulator 20 and the ground or chassis electrode 13. The narrow opening or bore 28, preferably, is centrally located and may have a diameter of between about 0.05 mm to 0.3 mm. To predetermine this opening 28, the insulator dome or body 20 may be formed with a small depression 29 at the predetermined location. Such a depression 29 may be formed at the outside of the insulator body 20 and/or at the inside of the dome-shaped bottom 20 thereof. Rather than using a single bore 28, a plurality of such openings 28 may be located in the bottom 20.

The manufacture of such openings or bores can be easily carried out by a laser beam, or by subjecting the center electrode and the ground electrode to a suitable voltage, causing arc-over through the insulator 18 to provide the opening therefor for subsequent sparking when installed in an automotive engine. Preferably, the voltage used will be higher than that of the expected ignition voltage in operation. The opening can also be formed mechanically, for example by introducing a suitably formed needle (not shown) and pressing it into the insulator 18 to break any remaining ceramic material in the region of the opening.

Operation: Let it be assumed that the spark plug of FIG. 1 is installed in an automotive-type internal combustion (IC) engine. Upon first starting the engine, the temperature of the spark plug will be at ambient temperature region. Upon initial operation, the combustion end of the insulator 18 will rapidly heat, since the insulator 18 is made of a material which is poorly heat conductive at ambient temperatures. Due to the gap 25 between the metal core 24 and insulator 18, heat is hardly transmitted by the insulator 18 away from the region where the heat is generated, and the combustion side end portion of the insulator 18 will rapidly reach the inherent combustion temperature of deposits which may form on the insulator, that is, a temperature which is between about 400° C. to 450° C. At this temperature, electrically conductive deposits will burn off inherently, or freely, from the insulator 18, thus avoiding electrical shunts or creep paths or deposits on the insulator 18, which might cause ignition failures.

When the temperature begins to exceed the range of about 450° C. to 500° C., the metal core will expand and, including its front end portion forming the center electrode 27, will so expand due to its temperature expansion characteristics that a substantial portion of the surface of the metal core 24 will engage the inner surface of the longitudinal bore 19 of the insulator, and especially within the range of the insulator bore portion 19/3—see FIG. 2. The metal core 24 will then rapidly conduct heat towards the terminal end portion of the spark plug.

The dimensions and the material of the insulator body 18 are so selected that the heat transmission to the connecting or terminal portion of the spark plug 10 is controlled, so that the metal core 24 will remain solid and not melt. Due to the solid phase of the insulator 18 is avoided, and short circuit between the center electrode 27 and the ground or chassis electrode 13 will be prevented.

Example: The metal core 24 is made of aluminum bronze. The outer diameter of the combustion side end portion of the insulator 18 is 3.8 mm, and extends over an axial length of 6 mm. The diameter of the combustion side portion 19/3 of bore 19 is 3 mm, and extends over a length of 15 mm. The diameter of the extended portion 17 of the insulator 18 increases to 9 mm, and the increase begins at about 13 mm starting from the bottom 20 of the insulator 18. The core 24, of aluminum bronze, has a length of 15 mm, and thus extends about up to the central region of the portion 19/2 of the opening 19 in the insulator.

Most of the spark plugs 10 of this type will have diameters of the portion 19/3 of the opening 19 of the insulator between 1 mm to 3 mm.

Aluminum bronze is a particularly desirable and suitable material for the center core 24, which is readily plastically deformable upon assembly of the spark plug, that is, upon assembly of the insulator 18, connecting bolt 21, sealing mass 23, and the core 24, and subsequent application of pressure. Other materials may be used for the core 24 which may liquefy at the melt-in temperature of the sealing mass 23, but which remain solid at the operating temperature of the spark plug, and have the requisite expansion characteristics upon heating, and the requisite heat conductivity. Aluminum is one of such metals.

Figure 3:
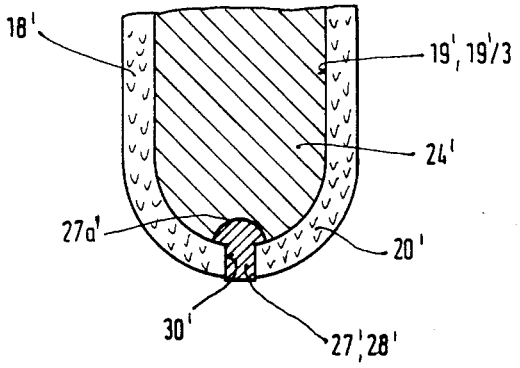
FIG. 3 is a fragmentary longitudinal sectional view of the end portion of a spark plug, illustrating another embodiment, in which the metal core and the ignition tip are separate elements.

Embodiment of FIG. 3: The electrical ignition path 28' between the center electrode 13 (not show) in the region of the insulator body 20' is formed by a center metallic pin 27'. The metal pin 27' is made of a material which is resistant to corrosion and burning, preferably a noble metal, for example a platinum metal or platinum. The metal pin 27' is located within an axial opening or bore 30' in the insulator body 20'. A diameter of 0.5 mm is suitable. The tip 28' has an internal head 27'a, which faces the metal core 24'. Depending on application, the metal pin 27' may have a thickness of between 0.2 mm to 1 mm, preferably, however, the diameter is between 0.3 mm and 0.6 mm.

The head 27'a may be formed at the outside of the insulator 18', or the pin may extend outside of the insulator, as shown, or two heads, similar to the head 27'a, may be provided. The metal pin 27' can be formed as desired; it can be flush with the outer surface of the dome or bottom portion 20'of the insulator 18', but may extend, as shown in FIG. 3, by some distance, for example about 1 mm, from the dome 20'.

FIG. 3 illustrates the operating condition at the combustion side end portion of the insulator 18' and metal core 24' in which the spark plug is at the operating temperature, that is, the core 24' is in engagement with the combustion chamber end portion of the opening 19'/3 of the longitudinal opening 19' of the insulator. The temperature of operation of the spark plug, as shown in FIG. 3, is above 450° C. If that spark plug would be cold, that is, would have a temperature of less than about 400° C. to 450° C., a gap would occur between the insulator bore 19' and the metal core 24', which mway lead to an interruption of the electrical connection between the metal core 24' and the tip or pin 27'. This gap, however, and as described, is very narrow. A small arc path will then result between the core 24' and the ignition tip 27'. This has some advantages for operation of the spark plug, as well known.

Rather than using a separate metal pin 27', which is fitted in the insulator bottom 20' and sintered therein, a suitable metallic suspension can be introduced at the end portion, and sintered together with the insulator 18'. A platinum suspension, for example as described in German Patent Disclosrure Document DE-OS No. 31 32 903, is suitable.

Figure 4:
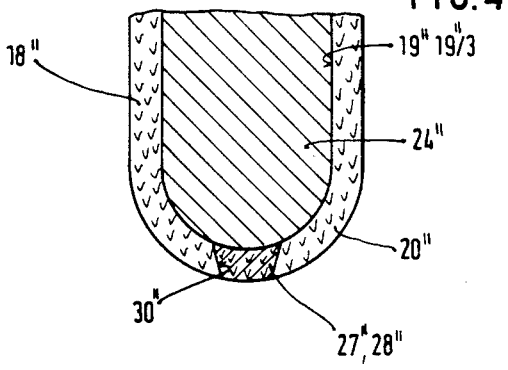
FIG. 4 is a view similar to FIG. 3, illustrating yet another embodiment, in which the ignition tip comprises an electrically conductive ceramic.

Embodiment of FIG. 4: The insulator 18'' has a metal core 24'' within its central opening 19''. The insulator 18'' is formed, at its dome-shaped end, with a central opening 30'' to form an electrical connecting path 28'' which includes an electrically conductive ceramic, thereby forming the center electrode 27'' of the spark plug. A suitable electrically conductive ceramic 27'' is a porous ceramic in which metals are located within the pores thereof. Such a ceramic composition may be made of aluminum oxide, without flux, and the metal within the pores may be aluminum. The aluminum within the pores of the porous ceramic portion 27''' can be introduced and melted therein at the same time as the metal core ≧''' is fitted within the longitudinal opening 19'' of the insulator 18''. Rather than using a material which is the same, or the same as a major portion of the core 24'' other metals may be used, for example silver, aluminum bronze, tin bronze; when using other materials, however, it is frequently necessary to utilize a separate operating step for introduction of the material within the ceramic.

In accordance with a feature of the invention, the electrically conductive path 28'', sintered within the insulator 18'' within the bottom region 20'' thereof, can be secured by means of cement or by a glaze, and contain other metals—see, for example, German Patent Disclosure Document DE-OS No. 28 54 071. The electrically conductive path 28'' may also include semiconductor material—see German Patent Disclosure Document DE-OS No. 27 29 099, or doped Perowskite ceramic—see German Patent Disclosure Document DE-OS No. 28 24 408. The semiconductor material, or the Perowskite ceramic, may have other metal powders added thereto, for example platinum, nickel, chromium, cobalt; other materials may be used which have been employed for electrical heating rods—see Swiss Patent No. 105,078.

When the spark plug is cool, the center core metal body 24'' will form a small gap with the tip 27'', 28''. Again, a small spark gap will result which, as well known, has some advantages in the operation of the plug.

Figure 5:
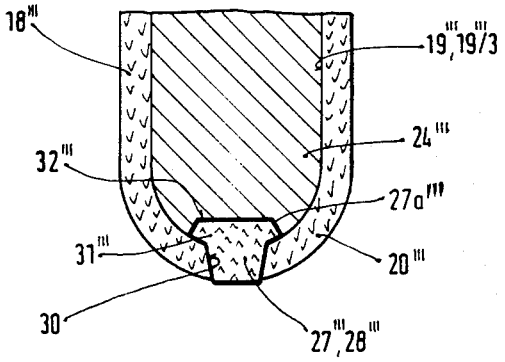
FIG. 5 is a view similar to FIG. 3, illustrating yet another embodiment in which the ignition tip comprises a conductive ceramic, and has an internal head.

Embodiment of FIG. 5: The insulator 18''' has a central opening 30 within which a center electrode 27''' is sintered, forming the electrical connecting path 28'''. The center electrode tip 27''' is made of an electrically insulating ceramic carrier 31''' which has a surface coating of an electrically conductive layer 32'''. A suitable conductive layer is platinum. Such a center electrode 27''' may be formed with a head 27'''*a*, or without a head. The head can be located interiorly, within the longitudinal bore 19''' or externally (not shown) (see German Patent Disclosure Document DE-OS No. 30 38 720). A short arc path will result if the spark plug is cold, that is, when the core 24''' is spaced from the insulator 18''' by a small gap, as in the embodiments of FIGS. 3 and 4.

Preferably, the center electrodes 27'', 27''' are flush with the outer surface of the dome-shaped bottom 20'', 20''', respectively, as shown in FIGS. 4 and 5; if the center electrodes project in form of a tip—FIG. 3—then the projection is, preferably, by about 1 mm.

Various changes and modifications may be made, and features described in connection with any one of the embodiments may be used with any of the others, within the scope of the inventive concept.

We claim:

1. Rapid-heating, high-temperature-stable, long-lifetime spark plug with self-adjusting variable heat conductivity, for an internal combustion (IC) engine, having a combustion chamber end and an external connection end;

a hollow metal housing (11,12);

a chassis or ground electrode (30) connected to the metal housing at the combustion chamber end;

an insulator (18) sealingly retained in the hollow metal housing, and formed with a central opening (19) therein; and a center electrode (21, 23, 24, 27, 28) located in the central opening (19) of the the insulator and including a connection post (21);

a spark tip (27,28) located opposite the chassis or ground electrode (13), a solid metal spark plug core segment (24), electrically connected to the spark tip, and an electrical circuit connection means (23) for electrically connecting the metal core and the connection post, wherein the solid metal core (24-24''') comprises a metal which is solid under all operating conditions of the spark plug, and said solid metal core is shaped to fit into the central opening (19) of the insulator and has a temperature coefficient of expansion such that, (A) at temperatures above the deposit burn-off temperature of said insulator a major portion of the surface of the metal core (24) expands into surface engagement with the portion (19-19''') of the wall of the insulator (18) defining said opening therein, and such that, (B) below said deposit burn-off temperature, said surface of said solid metal core is spaced from said portion of the wall surface of the insulator by a gap (25) thereby effecting rapid heating of said insulator to deposit burn-off temperature, by inhibiting rapid heat transfer from the insulator to said metal core, but preventing, by heat transfer to the center electrode including said metal core, excessive heating of the insulator tip portion to glow ignition temperature.

2. Spark plug according to claim 1, wherein the metal core (24-24''') comprises a material having a heat conductivity of at least 90 W/mK (Watt/Meter×Kelvin).

3. Spark plug according to claim 1, wherein the insulator has a cup-shaped or dome-shaped bottom (20-20'''), which has a thickness in the range 0.2 mm to 0.9 mm.

4. Spark plug according to claim 3, wherein the thickness of the dome-shaped bottom is in the range between 0.3 mm and 0.6 mm.

5. Spark plug according to claim 1, wherein the insulator (18-18''') is formed with a thin-walled end portion in the region of the portion of the opening where said gap (25) arises when the spark plug is below said temperature of about 450° to 500° C., said thin-walled portion having an axial length in the range between 2.5 mm and 12 mm, extending from the bottom or end (20-20''') of the insulator.

6. Spark plug according to claim 5, wherein said axial length is in the range 5 mm to 9 mm.

7. Spark plug according to claim 1, wherein the insulator essentially comprises aluminum oxide with a flux content of in the range 5% to 20%, by weight.

8. Spark plug according to claim 1, wherein the insulator essentially comprises aluminum oxide with a flux content of in the range 8% to 15% by weight.

9. Spark plug according to claim 1, wherein the electrical circuit connection means (23) comprises an electrically conductive meltable substance introduced into the spark plug, upon manufacture, under molten condition;

and wherein, in accordance with the invention, the metal core (24-24''') comprises a material which, at the melting temperature of said electrical circuit connection means (23) is plastically deformable, or liquid.

10. Spark plug according to claim 1, wherein the metal core (24-24''') comprises at least one of the materials of the group consisting of aluminum, copper, silver; brass; aluminum bronze, tin bronze; metal alloys having a substantial proportion of at least one of: aluminum, copper, silver.

11. Spark plug according to claim 1, wherein (FIGS. 1, 2) the insulator (18) is formed with a cup-shaped or dome-shaped bottom (20-20''');

said cup or dome-shaped bottom being formed with an opening (29) therein, and the adjacent portion of the metal core (24) forms the center or counter electrode for the chassis or ground electrode of the spark plug.

12. Spark plug according to claim 11, wherein the opening has a diameter in the range between 0.05 mm and 0.3 mm.

13. Spark plug according to claim 1, wherein (FIGS. 3–5) the insulator is formed with a cup-shaped or dome-shaped bottom (20'-20''');

and an electrically conductive element (27'-27''', 28'-28''') is located in said cup-shaped or dome-shaped bottom, passing through the insulator to form an electrically conductive path therethrough.

14. Spark plug according to claim 13, wherein (FIG. 3) the electrically conductive element comprises a metal pin (27').

15. Spark plug according to claim 14, wherein said metal pin has a diameter in the range between 0.2 mm and 1 mm.

16. Spark plug according to claim 14, wherein said metal pin comprises a noble metal, preferably a platinum metal.

17. Spark plug according to claim 13, wherein (FIG. 4) the conductive element comprises an electrically conductive ceramic.

18. Spark plug according to claim 13, wherein (FIG. 5) the electrically conductive element comprises an insulating ceramic having a metallic coating (32''') thereon.

19. Spark plug according to claim 13, wherein the center electrode is flush with the outer surface of the cup-shaped or dome-shaped bottom of the insulator.

20. Spark plug according to claim 13, wherein the center electrode projects from the outer surface of the cup-shaped or dome-shaped bottom of the insulator by a distance about 1 mm.

* * * * *